US010029888B2

(12) United States Patent
Lehtinen et al.

(10) Patent No.: US 10,029,888 B2
(45) Date of Patent: Jul. 24, 2018

(54) METHOD AND ARRANGEMENT

(71) Applicant: KONE CORPORATION, Helsinki (FI)

(72) Inventors: Hannu Lehtinen, Numminen (FI); Pekka Hallikainen, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 433 days.

(21) Appl. No.: 14/945,187

(22) Filed: Nov. 18, 2015

(65) Prior Publication Data

US 2016/0152445 A1 Jun. 2, 2016

(30) Foreign Application Priority Data

Dec. 1, 2014 (EP) ..... 14195564

(51) Int. Cl.
*B66B 7/08* (2006.01)
*B66B 7/12* (2006.01)
(Continued)

(52) U.S. Cl.
CPC ..... *B66B 7/1223* (2013.01); *B66B 7/085* (2013.01); *H01R 13/207* (2013.01); *H01R 13/639* (2013.01); *H01R 43/16* (2013.01)

(58) Field of Classification Search
CPC ..... B66B 7/1223; B66B 7/085; H01R 13/207; H01R 13/639; H01R 43/16
(Continued)

(56) References Cited

U.S. PATENT DOCUMENTS 7,506,728 B2 * 3/2009 Hawkes ..... B66B 7/1223 187/277
8,686,747 B2 * 4/2014 Berner ..... B66B 7/1223 187/391
(Continued)

FOREIGN PATENT DOCUMENTS

EP 2 534 082 A1 12/2012
WO WO 2009/090299 A1 7/2009
WO WO 2011/098847 A1 8/2011

*Primary Examiner* — Anthony Salata
(74) *Attorney, Agent, or Firm* — Birch, Stewart, Kolasch & Birch, LLP

(57) ABSTRACT

A method is provided for manufacturing an electrical contact arrangement on an end of a hoisting rope of a hoisting apparatus, which hoisting rope includes a non-conductive coating, and a plurality of adjacent conductive load bearing members for bearing the load exerted on the rope in a longitudinal direction thereof embedded in the coating and extending parallel to each other and to the longitudinal direction of the hoisting rope unbroken throughout the length of the rope, the coating forming the surface of the hoisting rope and extending between adjacent load bearing members thereby isolating them from each other, in which method a conductive plate element is placed beside the end of the hoisting rope; and the conductive plate element is attached immovably beside the end of the hoisting rope with at least one threaded screw member made of conductive material by screwing the threaded screw member into the hoisting rope such that it extends centrally between load bearing members next to each other, and such that the threads thereof are in contact with both of said load bearing members next to each other, the conductive plate element being thereby brought to be in conductive connection with both of said load bearing members next to each other via said at least one screw member.

20 Claims, 5 Drawing Sheets

(51) Int. Cl.
*H01R 13/207* (2006.01)
*H01R 13/639* (2006.01)
*H01R 43/16* (2006.01)

(58) Field of Classification Search
USPC ..... 187/247, 248, 251, 261, 264, 277, 391, 187/393, 411, 412, 413; 73/831, 832, 73/839, 862.56; 57/210, 211, 212, 217, 57/218, 222, 232, 237; 439/90, 579, 580, 439/582, 583, 585
See application file for complete search history.

(56) References Cited

U.S. PATENT DOCUMENTS

| | | | | |
|---|---|---|---|---|
| 9,385,447 | B2 * | 7/2016 | Dold | B66B 7/1223 |
| 9,422,134 | B2 * | 8/2016 | Ikonen | B66B 5/0031 |
| 9,862,571 | B2 * | 1/2018 | Sun | B66B 7/1223 |
| 9,862,572 | B2 * | 1/2018 | Fargo | B66B 7/1223 |
| 2002/0194935 | A1 * | 12/2002 | Clarke | B66B 7/1223 73/862.391 |
| 2015/0362450 | A1 * | 12/2015 | Lehtinen | B66B 19/02 187/391 |
| 2016/0221796 | A1 * | 8/2016 | Puranen | B66B 7/1223 |
| 2016/0272466 | A1 * | 9/2016 | Helenius | B66B 5/0031 |
| 2017/0029249 | A1 * | 2/2017 | Robibero | B66B 7/1215 |
| 2017/0036891 | A1 * | 2/2017 | Lehtinen | B66B 7/085 |
| 2017/0233222 | A1 * | 8/2017 | Puranen | B66B 5/02 187/247 |

* cited by examiner

C - C

METHOD AND ARRANGEMENT

FIELD OF THE INVENTION

The invention relates to a method for manufacturing an electrical contact arrangement on an end of a hoisting rope of a hoisting apparatus, and to an electrical contact arrangement on an end of a hoisting rope of a hoisting apparatus and to an arrangement for condition monitoring of a hoisting rope of a hoisting apparatus. Said hoisting apparatus is preferably an elevator for transporting passengers and/or goods.

BACKGROUND OF THE INVENTION

Hoisting ropes typically include one or several load bearing members that are elongated in the longitudinal direction of the rope, each load bearing member forming a structure that continues unbroken throughout the length of the rope. Load bearing members are the members of the rope which are able to bear together the load exerted on the rope in its longitudinal direction. The load, such as a weight suspended by the rope, causes tension on the load bearing member in the longitudinal direction of the rope, which tension can be transmitted by the load bearing member in question all the way from one end of the rope to the other end of the rope. Ropes may further comprise non-bearing components, such as an elastic coating, which cannot transmit tension in the above described way.

In prior art, such hoisting ropes exist where the load bearing members are embedded in non-conducting coating, such as polymer coating, forming the surface of the hoisting rope and extending between adjacent load bearing members thereby isolating them from each other both mechanically and electrically. For facilitating awareness of condition of the condition of ropes, and thereby for improving safety of the hoisting apparatus, monitoring of the condition of the load bearing members has been proposed. The condition monitoring has been proposed in prior art to be arranged by monitoring electrical parameters of the load bearing members. Such parameters may include resistance for instance. For this purpose, the load bearing members need to be connected electrically to a source of electricity. A drawback has been that there has not been an effective and simple way for providing the electrical connection.

Furthermore, such solutions exist where said load bearing members are in the form of elongated composite members made of composite material comprising reinforcing fibers in polymer matrix. In this type of solutions, establishing the electrical connection has been particularly challenging owing to the fragility of the composite material of the load bearing members.

BRIEF DESCRIPTION OF THE INVENTION

The object of the invention is to introduce a method for manufacturing an electrical contact arrangement on an end of a hoisting rope of a hoisting apparatus, as well as an electrical contact arrangement on an end of a hoisting rope of a hoisting apparatus, and an arrangement for condition monitoring of a hoisting rope of a hoisting apparatus, and a hoisting apparatus, wherein an electrical contact is provided for load bearing members next to each other in a manner improved in terms of simplicity of structure and ease of implementation. Advantageous embodiments are furthermore presented, inter alia, wherein a contact interface is provided via which electricity is simply conducted into load bearing members. Advantageous embodiments are furthermore presented, inter alia, wherein process steps requiring accuracy can be carried out quickly with excellent quality.

It is brought forward a new method for manufacturing electrical contact arrangement on an end of a hoisting rope of a hoisting apparatus, which hoisting rope comprises a non-conductive coating, and a plurality of adjacent conductive load bearing members for bearing the load exerted on the rope in longitudinal direction thereof embedded in the coating and extending parallel to each other and to the longitudinal direction of the hoisting rope unbroken throughout the length of the rope, the coating forming the surface of the hoisting rope and extending between adjacent load bearing members thereby isolating them from each other (both mechanically and electrically), and in the method a conductive plate element is placed beside the end of the hoisting rope; and the conductive plate element is attached immovably beside the end of the hoisting rope with at least one threaded screw member made of conductive material by screwing the screw member into the hoisting rope such that it extends centrally between load bearing members next to each other, and such that the threads thereof are in contact with both of said load bearing members next to each other, the contact element being thereby brought to be in conductive connection with both of said load bearing members next to each other via said at least one screw member. Hereby, one or more of the above mentioned advantages and/or objectives are achieved. These advantages and/or objectives are further facilitated with the additional preferred features and/or steps described in the following.

In a preferred embodiment, said at least one threaded screw member is screwed to compress with its screw head directly the conductive plate element, or indirectly via only conductive members such as one or more washers.

In a preferred embodiment, said conductive plate element is a contact element that can be directly coupled with another contact element. Thereby, said conductive plate element can serve as a contact interface via which electricity can be conducted into both of said load bearing members.

In a preferred embodiment, in the method said contact element is coupled directly with a contact element of a source of electricity, in particular to a contact element of the source of electricity serving as a positive or negative terminal thereof. Thereby, said conductive plate element can serve as a contact interface via which electricity can be conducted into both of said load bearing members from a source of electricity In a preferred embodiment, before said placing and screwing, a hole is pre-drilled into the coating which hole extends centrally between load bearing members next to each other, and in said screwing the screw member is screwed into the pre-drilled hole.

In a preferred embodiment, before said pre-drilling, the rope is mounted on a jig comprising a plurality of stop faces configured to accurately place the rope relative to the jig, and thereby relative to features thereof, particularly relative to guide hole(s) and/or guide edges thereof, when the rope is mounted on the jig, particularly placed against the stop faces. The hole is then pre-drilled into the coating while the rope is mounted on the jig.

In a preferred embodiment, said jig comprises one or more guide holes for guiding a drill bit of a drill, and each said pre-drilling is carried out by drilling through a guide hole while the rope is mounted on the jig.

In a preferred embodiment, said plurality of stop faces comprised in the jig are configured to accurately place the rope relative to the jig such that when the rope is mounted on the jig, each guide hole points towards the center of the gap between load bearing members which are next to each other.

In a preferred embodiment, said jig comprises at least a first stop face for supporting the thickness directional side (i.e. flank) of the rope and a second stop face for supporting the width directional side of the rope, and each said guide hole is at a distance from the first stop face corresponding to the distance (as measured in width direction of the rope) between the thickness directional side of the rope and the center of the gap between the load bearing members of the rope which are next to each other (as measured in width direction of the rope). The second face is preferably orthogonal to the first face whereby the jig is well suitable for being used with belt-shaped ropes. Preferably, the jig comprises two of said first stop faces (one for each thickness directional sides, i.e. flanks, of the rope) at a distance from each other corresponding to the width of the rope.

In a preferred embodiment, said rope is belt-shaped, i.e. larger in width direction than thickness direction.

In a preferred embodiment, said plurality of stop faces comprised in the jig are configured to accurately place the rope relative to the jig such that when the rope is mounted on the jig an end of the rope can extend/extends over a guide edge extending in width direction of the rope, and after said mounting the rope is cut, e.g. by sawing, along the guide edge in width direction of the rope.

In a preferred embodiment, said mounting comprises tightening the hoisting rope immovably on the jig, in particular against stop faces of the jig.

In a preferred embodiment, the jig preferably comprises parts, preferably two opposing halves, each comprising stop faces, and said parts defining an inside space wherein the rope can be inserted, said parts being movable towards each other such that the inside space is constricted, at least some of the stop faces of the jig thereby being movable towards the rope placed in the inside space. Said tightening is performed with tightening means such as tightening screws for moving the parts towards each other such that the inside space is constricted, whereby stop faces of the jig compress against the rope from plural directions.

In a preferred embodiment, said method comprises placing beside the end of the hoisting rope one or more plate elements, in particular such that they form a stack, said one or more plate elements including at least the conductive plate element, and said screwing is carried out while the rope and one or more plate elements placed beside the end thereof, including at least the conductive plate element, are mounted on the jig, preferably such that at least the rope is immovable relative to the jig. This is preferably, but not necessarily, performed such that the components are stacked outside the jig. For this purpose after said pre-drilling, the rope is removed from the jig. Then, the method comprises placing beside the end of the hoisting rope one or more plate elements, in particular such that they form a stack, said one or more plate elements including at least the conductive plate element, and thereafter mounting the rope and said one or more plate elements, including at least the conductive plate element, together on the jig, said mounting comprising tightening the stack in the jig, preferably such that at least the rope is immovable in the jig, and after the mounting said screwing is carried out while the rope and said one or more plate elements are mounted on the jig.

In a preferred embodiment, for enabling screwing the screw member(s) into the rope while the rope is mounted on the jig, the jig comprises an opening through which the screw member(s) can be screwed into the rope.

In a preferred embodiment, said conductive plate element has been pre-formed before beginning the method on installation site, such as in a factory, to comprise an opening, preferably a hole, through which a screw member can be placed to extend.

In a preferred embodiment, the stack is mounted on the jig such that the hoisting rope and said one or more plate elements are placed relative to each other such that the opening of the jig, the opening of the conductive plate element and the predrilled hole are all eclipsed such that a screw member can be screwed through the openings into the pre-drilled hole.

It is also brought forward a new electrical contact arrangement on an end of a hoisting rope of a hoisting apparatus, which hoisting rope comprises a non-conductive coating, and a plurality of adjacent conductive load bearing members for bearing the load exerted on the rope in longitudinal direction thereof embedded in the coating and extending parallel to each other and to the longitudinal direction of the hoisting rope unbroken throughout the length of the rope, the coating forming the surface of the hoisting rope and extending between adjacent load bearing members thereby isolating them from each other, which electrical contact arrangement comprises a conductive plate element attached on the end of the hoisting rope; and at least one threaded screw member attaching the conductive plate element immovably beside the end of the hoisting rope, which threaded screw member is screwed into the rope such that it extends centrally between load bearing members next to each other the threads thereof being in contact with both of said load bearing members next to each other, the threaded screw member being made of conductive material, and the conductive plate element is in conductive connection with both of said load bearing members next to each other via said at least one threaded screw member. The threaded screw member thereby connects the contact element conductively with both said load bearing members.

In a preferred embodiment, said conductive plate element is a contact element directly coupled/couplable with a contact element of a source of electricity. Thereby, said conductive plate element can serve as a contact interface via which electricity can be conducted into both of said load bearing members from the source of electricity.

In a preferred embodiment, said conductive plate element comprises a portion protruding away from the rope forming a contact pin that can be directly coupled with another contact element forming a counterpart for the pin, such as with a contact element of a source of electricity.

In a preferred embodiment, said threaded screw member has a screw-head compressed against the conductive plate element directly or indirectly via only conductive members such as one or more washers.

In a preferred embodiment, a non-conductive support plate element is provided between the rope and the conductive plate element. The conductive plate element is then placed beside the end of the hoisting rope such that it leans directly against the support plate which leans directly against the rope, but the conductive plate element could of course alternatively be placed beside the end of the hoisting rope such that it leans directly against the rope.

In a preferred embodiment, said hoisting rope comprises at least four of said load bearing members, and said electrical contact arrangement comprises at least two of said conductive plate elements attached on the end of the hoisting rope, said two conductive plate elements being separate from each other and in conductive connection with mutually different load bearing members next to each other in the defined way. Then one of said conductive plate elements is in conductive connection with first pair of load bearing members next to each other via at least one first screw, and the other of said conductive plate elements is in conductive connection with second pair of load bearing members next to each other via at least one second screw.

In a preferred embodiment, the electrical contact arrangement has been obtained with the method according to any of the preceding claims. Particularly, by using the jig a process steps requiring accuracy can be carried out quickly with excellent quality.

It is also brought forward a new arrangement for condition monitoring of a hoisting rope of a hoisting apparatus wherein load bearing members of the hoisting rope that are next to each other, are in conductive connection with each other and form part of an electrical circuit whereto a source of electricity is connected, which arrangement for condition monitoring comprises a monitoring unit for monitoring one or more electrical parameter of the electrical circuit so as to determine condition of the circuit, the condition monitoring unit being configured to deduce condition of the load bearing members of the rope, based on condition of the circuit, the arrangement comprising on at least one end of the hoisting rope an electrical contact arrangement as defined in any of the preceding claims connecting said load bearing members of the hoisting rope that are next to each other to be in conductive connection with each other.

In a preferred embodiment, said conductive plate element of the electrical contact arrangement is a contact element directly coupled with a contact element of a source of electricity U. Thereby, said conductive plate element serves as a contact interface via which electricity is conducted into both of said load bearing members from the source of electricity. The contact element of the source of electricity can be one serving as a positive or negative terminal thereof.

In a preferred embodiment, said conductive plate element comprises a portion protruding away from the rope forming a contact element in the form of a contact pin that is directly coupled with another contact element such as with a contact element of a source of electricity. The contact element of the source of electricity can be one serving as a positive or negative terminal thereof.

In a preferred embodiment, said hoisting rope comprises at least four of said load bearing members, and said electrical contact arrangement comprises at least two of said conductive plate elements attached on the end of the hoisting rope, said two conductive plate elements being separate from each other and in conductive connection with mutually different load bearing members next to each other in the defined way.

In a preferred embodiment, said load bearing members are made of composite material comprising electrically conducting reinforcing fibers in polymer matrix, said reinforcing fibers preferably being carbon fibers.

Preferably over 50% proportion of the surface area of the cross-section of the load bearing member consists of the aforementioned electrically conducting reinforcing fibers. Thereby, good conductivity can be ensured. The reinforcing gibers will be in contact with each other randomly along their length whereby electricity brought into the load bearing member by the screws will be conducted within substantially the whole cross section of the load bearing member. Preferably, substantially all the remaining surface area is of polymer matrix. To be more precise preferably 50%-80% of the surface area of the cross-section of the load bearing member is of the aforementioned reinforcing fiber, most preferably such that 55%-70% is of the aforementioned reinforcing fiber, and substantially all the remaining surface area is of polymer matrix. In this way conductivity and longitudinal stiffness of the load bearing member are facilitated, yet there is enough matrix material to bind the fibers F effectively to each other. The best results are achieved when approx. 60% of the surface area is of reinforcing fiber and approx. 40% is of matrix material.

In a preferred embodiment, each said load bearing member is parallel with the length direction of the rope. Furthermore, it is preferable that said reinforcing fibers are parallel with the length direction of the rope. Thereby the fibers are also parallel with the longitudinal direction of the rope as each load bearing member is oriented parallel with the longitudinal direction of the rope. This facilitates further the longitudinal stiffness of the rope among other properties highly appreciated in a hoisting rope.

In a preferred embodiment, the reinforcing fibers of each load bearing member are distributed in the polymer matrix of the load bearing member in question and bound together by it to form a one integral piece. The reinforcing fibers of each load bearing member are then preferably substantially evenly distributed in the polymer matrix of the load bearing member in question.

In a preferred embodiment, the module of elasticity E of the polymer matrix is over 2 GPa, most preferably over 2.5 GPa, yet more preferably in the range 2.5-10 GPa, most preferably of all in the range 2.5-3.5 GPa. In this way a structure is achieved wherein the matrix essentially supports the reinforcing fibers, in particular from buckling. One advantage, among others, is a longer service life. With this kind of material of the load bearing members, the tendency to straighten is particularly strong, whereby in this context the measures for alleviating the problems of straightening of rope during installation are particularly advantageous.

The elevator is preferably such that the car thereof is arranged to serve two or more landings. The hoisting rope is preferably arranged to suspend at least the elevator car. The elevator preferably controls movement of the car in response to calls from landing and/or destination commands from inside the car so as to serve persons on the landing(s) and/or inside the elevator car. Preferably, the car has an interior space suitable for receiving a passenger or passengers, and the car can be provided with a door for forming a closed interior space.

BRIEF DESCRIPTION OF THE DRAWINGS

In the following, the present invention will be described in more detail by way of example and with reference to the attached drawings, in which.

The foregoing aspects, features and advantages of the invention will be apparent from the drawings and the detailed description related thereto.

DETAILED DESCRIPTION

Figure 1:
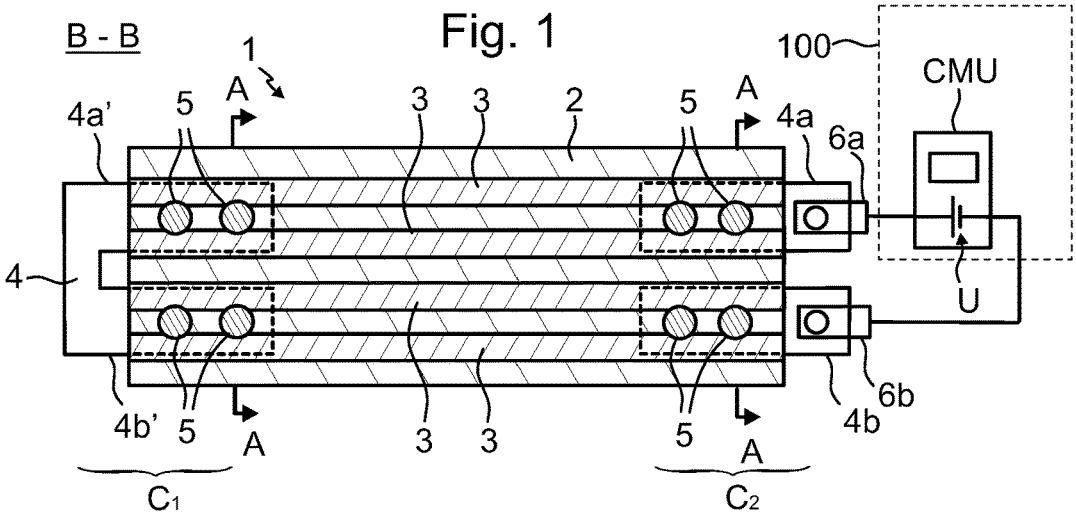
FIG. 1 illustrates an electrical contact arrangement provided for a hoisting as implemented in an arrangement for condition monitoring of said hoisting rope.

FIG. 1 illustrates a hoisting rope 1 of a hoisting apparatus, which hoisting rope 1 is belt-shaped, i.e. larger in width direction than thickness direction. The hoisting rope 1 comprises a non-conductive coating 2, and a plurality of conductive load bearing members 3 for bearing the load exerted on the rope 1 in longitudinal direction thereof, which are adjacent in width direction of the hoisting rope 1. The load bearing members 3 are embedded in the non-conductive coating 2 and extend parallel to each other as well as to the longitudinal direction of the hoisting rope 1 unbroken throughout the length of the rope 1. The coating 2 forms the surface of the hoisting rope 1 and extends between adjacent load bearing members 3, thereby isolating them from each other both mechanically and electrically. FIG. 1 illustrates an arrangement for condition monitoring of said hoisting rope 1 wherein electrical contact arrangements C1 and C2 are provided to bring load bearing members 3 of the hoisting rope 1 that are next to each other to be in conductive connection with each other and to form part of an electrical circuit whereto a source of electricity U is connected. The arrangement for condition monitoring further comprises a condition monitoring unit CMU for monitoring one or more electrical parameter of the electrical circuit so as to determine condition of the circuit. Such parameters may include resistance for instance. The condition monitoring unit CMU is configured to deduce condition of the load bearing members 3 of the rope 1, and thereby the condition of the rope, based on condition of the circuit. The CMU may be comprised in the control system 100 for controlling the hoisting apparatus, such as in the elevator control system in case the hoisting apparatus is an elevator for transporting passengers and/or goods. The CMU may be in the form of a digital multimeter, for instance.

The arrangement for condition monitoring comprises an electrical contact arrangement C1, C2 provided on each end of the hoisting rope 1, whereby individual load bearing members 3 are connected to other electrically conducting members of the circuit. Thereby, each load bearing member 3 is arranged to form part of said electrical circuit in the arrangement for condition monitoring of said hoisting rope 1.

In the illustrated embodiment, the rope 1 comprises four load bearing members 3. On the first end (on the right in FIG. 1), there is a first conductive plate element 4*a* connected conductively with a pair load bearing members 3 next to each other and a second conductive plate element 4*b* connected conductively with different pair of load bearing members 3 next to each other. On the second end (on the left in FIG. 1), load bearing members 3 of both said pairs are conductively connected to each other. For this purpose, on the second end, there is one conductive plate element 4 connected conductively with each of said load bearing members 3. Thus, all the load bearing members 3 are conductively connected on the second end to each other.

On the first end of the hoisting rope 1 the load bearing members 3 next to each other have been conductively connected with an electrical contact arrangement C1. This electrical contact arrangement C1 comprises a first and second conductive plate element 4*a*,4*b* attached on the end of the hoisting rope 1 separate from each other, which conductive plate element 4*a*,4*b* are in conductive connection with different pairs of load bearing members 3. The electrical contact arrangement C1 comprises at least one threaded screw member 5, in this case two of them, attaching each conductive plate element 4*a*,4*b* immovably beside the end of the hoisting rope 1, which threaded screw member 5 is screwed into the hoisting rope 1, in particular into the coating 2 thereof, such that it extends centrally between a pair of load bearing members 3 next to each other the threads thereof being in contact with both of said pair of load bearing members 3 next to each other. The threaded screw member 5 is made of conductive material, and each conductive plate element 4*a*,4*b* is in conductive connection with both of said load bearing members 3 next to each other via said threaded screw members 5. The threaded screw member 5 thereby connects the conductive plate element 4*a*,4*b* conductively with both of said load bearing members 3 next to each other. The threaded screw members 5 are preferably threaded screws.

Each of said conductive plate elements 4*a*, 4*b* is a contact element coupleable directly with another contact element that does not form part of the rope or the electrical contact arrangement C1, said another element in this case being a contact element 6*a*,6*b* of a source of electricity U. Thus, each conductive plate element 4*a*, 4*b* can serve as a contact interface via which an electrical connection can be established between the load bearing members 3 next to each other and the source of electricity U. As illustrated in FIG. 1, in the preferred embodiment conductive plate elements 4*a*, 4*b* are contact elements coupled with different contact elements 6*a*, 6*b* of a source of electricity U, namely contact elements 6*a* and 6*b* one of which serves as the positive terminal and the other as the negative terminal of the source of electricity U.

On the second end of the hoisting rope 1 there is an electrical contact arrangement C2. This electrical contact arrangement C2 comprises a conductive plate element 4 attached on the end of the hoisting rope 1, which conductive plate element 4 is in conductive connection with all of said load bearing members 3. The electrical contact arrangement C2 comprises several threaded screw members 5, attaching the conductive plate element 4 immovably beside the end of the hoisting rope 1. Threaded screw members 5 have been screwed into the hoisting rope 1, in particular into the coating 2 thereof, such that one extends centrally between each pair of load bearing members 3 next to each other the threads thereof being in contact with both of the load bearing members 3 next to each other. The threaded screw member 5 is made of conductive material, and the conductive plate element 4 is in conductive connection with all of said load bearing members 3 next to each other via said threaded screw members 5. Each threaded screw member 5 thereby connects the contact element 4 conductively with both of the load bearing members 3 next to each other between which it has been screwed.

As shown in the FIG. 1, it is preferable that each conductive plate element 4*a*, 4*b* serving as a contact interface via which an electrical connection can be established between the load bearing members 3 next to each other and the source of electricity U comprises a portion protruding away from the rope forming a contact interface in the form of a contact pin that can be directly coupled with another contact element forming a counterpart for the pin, in this case with a contact element 6*a*,6*b* of a power supply U.

With each arrangement C1,C2 the threaded screw member 5 is electrically connected with the conductive plate element 4;4*a*,4*b*. As shown in the FIG. 2, it is preferable that said threaded screw member 5 has a screw-head compressed against the conductive plate element directly (as shown) or indirectly via only conductive members such as one or more washers.

The conductive plate element 4;4*a*,4*b* is preferably made of metal. The non-conductive coating 2 is preferably made of polymer material, most preferably of elastomer, such as polyurethane. Said conductive load bearing members 3 are preferably made of composite material comprising reinforcing fibers embedded in polymer matrix, which reinforcing fibers are conductive. Most preferably said fibers are carbon fibers, whereby the rope is well suitable for elevator use particularly owing to its superb properties in terms of load bearing capacity and weight.

As shown in the FIG. 1, it is preferable that the conductive plate element 4;4*a*,4*b* is attached beside the end of the hoisting rope 1 immovably via a non-conductive support plate element 7 positioned between the rope 1 and the conductive plate element 4;4*a*,4*b* such that it leans directly against and parallel with the side of the rope 1 facing in thickness direction of the rope 1. The plate element 4;4*a*,4*b* on the other hand comprises at least a completely flat portion that leans directly against and parallel with the back side of the non-conductive support plate element 7. A support element is preferably provided in this way on both sides of the rope 1 as seen in thickness direction thereof. The support element 7 gives support for the contact arrangement C1,C2 and facilitates the process for attaching, in particular the screwing phase. Alternatively, the conductive plate element could of course alternatively be placed beside the end of the hoisting rope such that it leans directly against the rope 1, e.g. if the benefits of said support plate 7 are deemed unnecessary in some case.

Each electrical contact arrangement C1,C2 can be manufactured with the method as described elsewhere in the application. A preferred embodiment of the method will be described in details in the following referring to FIGS. 3 to 10.

FIGS. 3 to 11 illustrate steps of a method for manufacturing electrical contact arrangement C1,C2 on an end of a hoisting rope 1 of a hoisting apparatus, which hoisting rope 1 comprises a non-conductive coating 2, and a plurality of adjacent conductive load bearing members 3 for bearing the load exerted on the rope in longitudinal direction thereof embedded in the coating 2 and extending parallel to each other and to the longitudinal direction of the hoisting rope unbroken throughout the length of the rope 1, wherein the coating 2 form the surface of the hoisting rope 1 and extends between adjacent load bearing members 3 thereby isolating them from each other both mechanically and electrically. In the method a rope 1 as defined is provided and a conductive plate element 4;4*a*,4*b* is placed beside the end of the hoisting rope 1; and the conductive plate element 4;4*a*,4*b* is attached immovably beside the end of the hoisting rope 1 with at least one threaded screw member 5 made of conductive material by screwing the screw member 5 into the hoisting rope 1, in particular into the coating 2 thereof, such that it extends centrally between load bearing members 3 next to each other, and such that the threads thereof are in contact with both of said load bearing members 3 next to each other, the contact element 4 being thereby brought to be in conductive connection with both of said load bearing members 3 next to each other via said at least one screw member 5. So as to connect the screw member 5 with the conductive plate element, each said screw 5 is screwed to compress with its screw head the conductive plate element directly (or alternatively indirectly via only conductive members such as one or more washers). These particular steps have been illustrated in FIGS. 9 and 10. So as to facilitate these steps and the overall process generally, several steps in addition to those mentioned are also performed. All the preferred steps will be described as a sequence referring to FIGS. 3 to 11.

In the preferred embodiment of the method, as illustrated in FIGS. 3 to 11 a jig 10 is used.

Figure 3:
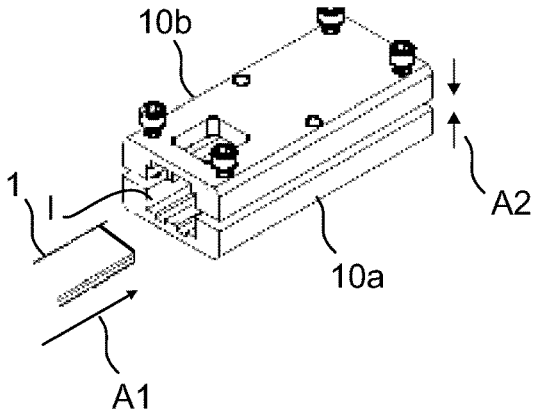
FIGS. 3 and 5-11 illustrate steps of a method for manufacturing an electrical contact arrangement of FIG. 1.
Figure 4:
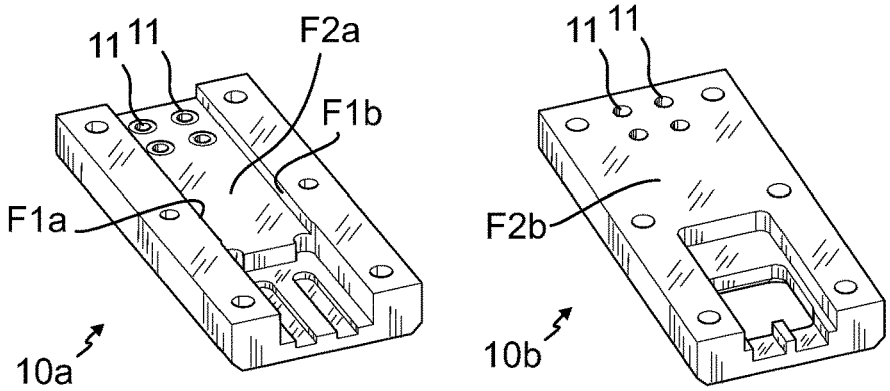
FIG. 4 illustrates a jig utilized in the method for manufacturing an electrical contact arrangement of FIG. 1.

The method comprises first providing a rope 1 as well as the jig 10, such as the one illustrated in FIG. 4, comprising a plurality of stop faces F1*a*,F1*b*,F2*a*,F2*b* configured to accurately place the rope relative to the jig 10 and thereby relative to features thereof, particularly relative to guide hole(s) 11 and/or guide edges 12 thereof which will be later described, when the rope 1 is placed against the stop faces F1*a*,F1*b*,F2*a*,F2*b*. The jig 10 is preferably such that it comprises movable parts 10*a*,10*b*, in this illustrated embodiment two halves, each comprising stop faces F1*a*,F1*b*,F2*a*, F2*b*, which parts together define an inside space I wherein the rope 1 can be inserted, said parts being movable towards each other such that the inside space I is constricted, at least some of the stop faces F1A,F1B,F2A,F2B of the parts thereby being movable towards the rope 1 when it is placed in the inside space I. The rope 1 is then mounted on the jig 10 such that the rope 1 is placed against said stop faces F1A,F1B,F2A,F2B. As illustrated in FIG. 3 said mounting comprises inserting the rope in an inside space I of the jig 10, the arrow A1 showing the direction of movement of the rope 1 relative to the jig 10. Said mounting further comprises tightening the rope 1 immovably on the jig 10, in particular against stop faces F1A,F1B,F2A,F2B of the jig. Said tightening is in this case implemented with tightening means 13, particularly in the form of tightening screws, which tightening means 13 move movable parts 10*a* and 10*b* of the jig 10 towards each other such that the inside space I of the jig 10 wherein the rope is placed is constricted (the arrow A2 showing the direction of movement of the parts relative to each other) whereby stop faces F1A,F1B,F2A,F2B of the jig are compressed against the rope 1 from plural directions. The jig 10 is releasable so as to allow later removal of the components away from the inside space I.

Figure 5:
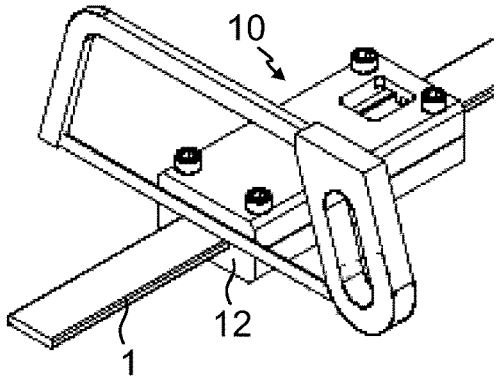

FIG. 5 illustrates a preferred, although in some cases unnecessary, step wherein the jig 10 is used for aiding the cutting of the rope end accurately in correct shape. For example, if the end of the rope 1 is not shaped as desired, the jig 10 can be used to reshape the end of the rope 1. For this purpose, the jig 10 is provided with structure facilitating this use. In this case, said a plurality of stop faces F1A,F1B, F2A,F2B comprised in the jig are configured to accurately place the rope 1 relative to the jig 10 such that when the rope 1 is mounted on the jig 10 an end of the rope 1 can extend/extends over a guide edge 12 extending in width direction of the rope 1, and after said mounting the rope 1 is cut, e.g. by sawing, along the guide edge 12 in width direction of the rope 1, as illustrated in FIG. 3. Thus, an end face is provided for the rope 1, which extends exactly in direction orthogonal to the longitudinal direction of the rope 1.

Figure 6:
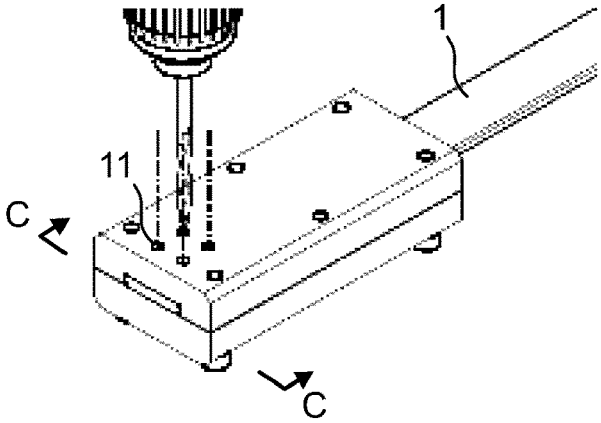
Figure 7:
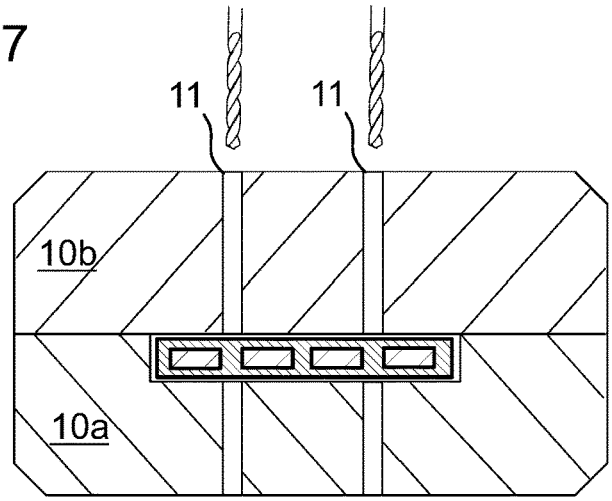

FIGS. 6 and 7 illustrate a preferred further step wherein the jig 10 is used for aiding the accurate positioning of the screws. After said mounting, a hole 8 is pre-drilled into the coating 2 which hole 8 extends centrally between load bearing members 3 next to each other, the hole 8 forming a predrilled hole in which in said screwing the screw member 5 is to be screwed. For this purpose, the jig 10 is provided with structure facilitating this predrilling operation. In particular, the jig 10 comprises one or more guide holes 11, and each said pre-drilling is carried out through a guide hole 11. Said drilling is preferably carried out for each screw member 5 to be screwed into the rope 1. For correct positioning of the guide holes relative to the rope 1, said plurality of stop faces F1A,F1B,F2A,F2B comprised in the jig 10 are configured to accurately place the rope 1 relative to the jig such that when the rope 1 is mounted on the jig 10, each said guide hole 11 points towards the center of the gap between load bearing members 3 which are next to each other.

Figure 8:
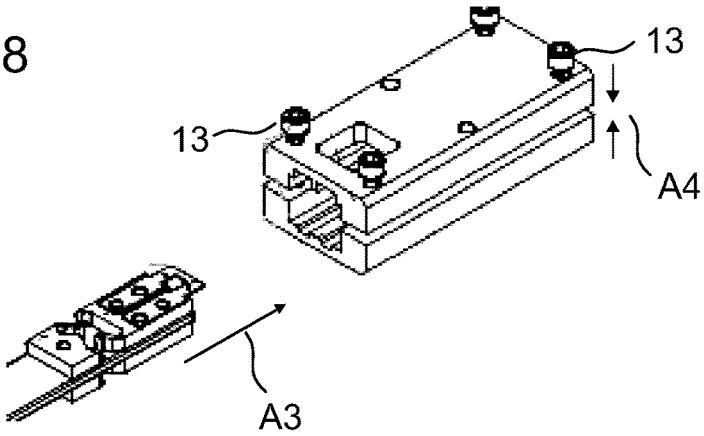
Figure 9:
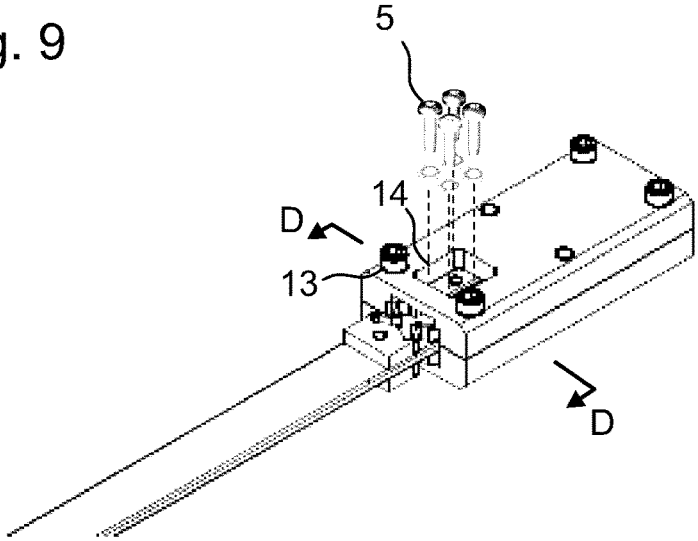
Figure 10:
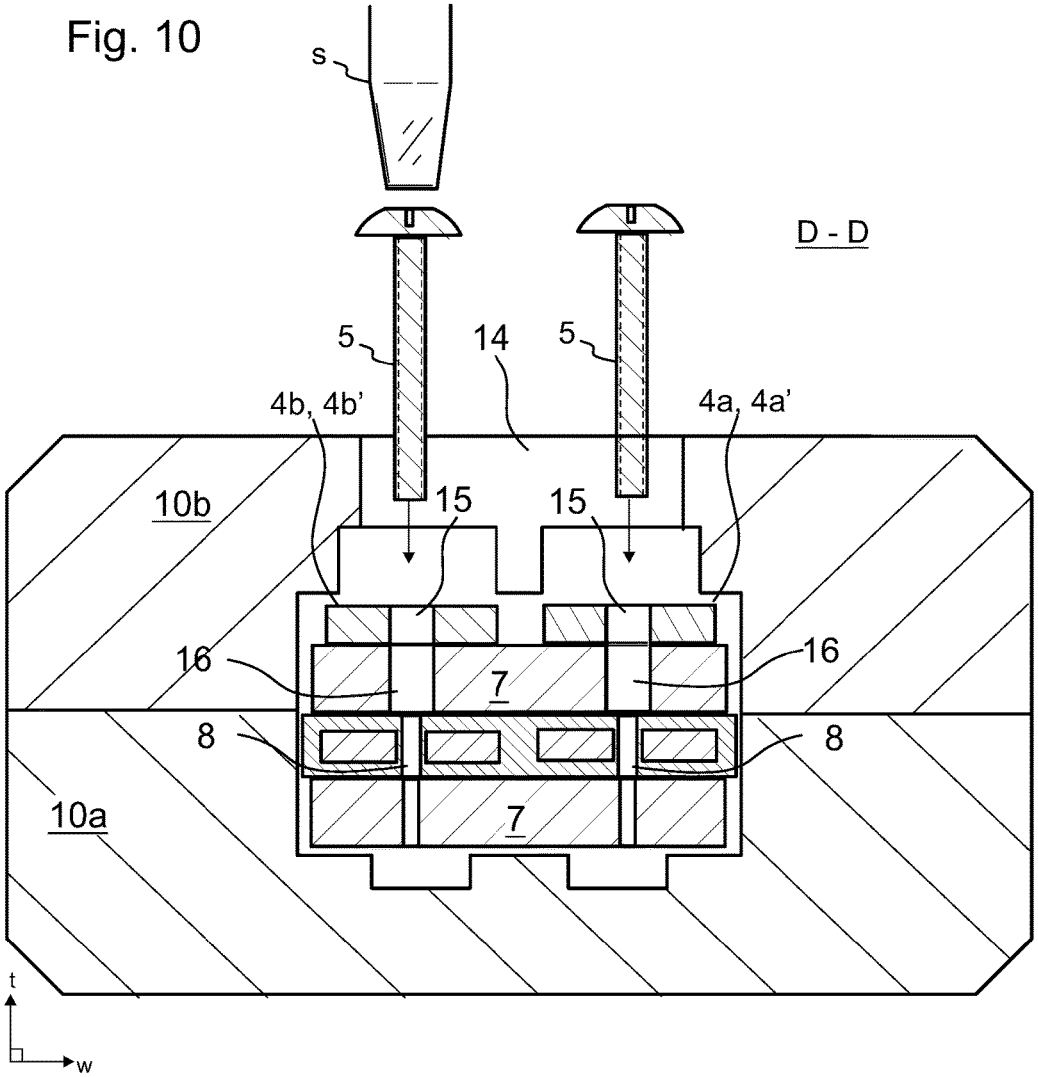
Figure 11:
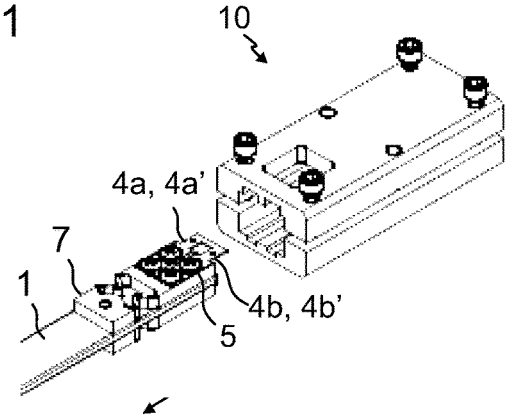

After the rope has been preprocessed while it is mounted on the jig 10, i.e. after said pre-drilling and/or said cutting performed on the rope 1 while it is mounted immovably on the jig 10, the rope 1 is removed from the jig 10. After this, the method comprises placing beside the end of the hoisting rope 1 one or more plate elements 4; 4*a*,4*b*; 7 such that the rope 1 and the plate elements form together a stack, said one or more plate elements including at least the conductive plate element 4;4*a*,4*b*, and thereafter mounting the rope 1 and said one or more plate elements together in the jig 10 as a stack. The aforementioned plate elements, including at least the conductive plate element 4;4*a*,4*b* are after this attached immovably beside the hoisting rope 1 while the hoisting rope 1 and the aforementioned plate elements 4;4*a*,4*b* are mounted on the jig 10. As illustrated in FIG. 8 said mounting comprises inserting the stack in an inside space I of the jig 10, the arrow A3 showing the direction of movement of the stack relative to the jig 10. The stack is moved as far as it goes inside the inside space I. However, the jig 10 being shaped in this case as shown in FIG. 3, the stack does not fit as far inside the jig 10 as the rope 1 alone fitted when being mounted alone. The inside space I of the jig 10 comprises a first portion and second portion, the first portion being dimensioned to receive the rope 1 alone and the second portion being dimensioned to receive the stack. Said second portion is enlarged as compared to the first portion for the purpose of receiving the rope 1 but also the components placed beside the end of the rope 1 as well. For the purpose of screwing the screw(s) 5 into the rope 1 while the rope 1 is mounted on the jig 10, the jig 10 comprises an opening 14 through which the screw(s) 5 can be screwed into the rope 1. When the stack is mounted on the jig 10, said conductive plate element 4; 4*a*,4*b* already comprises an opening 15, preferably in the form of a hole as showed, through which a screw 5 can be placed to extend. The stack comprises in this embodiment also a support plate 7, which also comprises an opening 16, which is in this case a hole, through which opening 16 a screw 5 can be placed to extend. The stack is mounted on the jig 10 such that the hoisting rope 1 and said one or more plate elements 4; 4*a*,4*b* are placed relative to each other such that the opening 14 of the jig 10, the opening 15 of the conductive plate element, the opening 16 of the support plate 7 and the predrilled hole 8 are all eclipsed such that a screw 5 can be screwed through the openings 14 and 15 into the hole 5 as illustrated in FIGS. 9 and 10. Said mounting further comprises tightening the stack in the jig 10, preferably such that at least the rope 1 is immovable relative to the jig, in particular against stop faces of the jig 10, which tightening is to be carried out in corresponding manner as described earlier for the rope 1 alone (the arrow A4 showing the direction of movement of the parts 10*a*,10*b* relative to each other). In this stage, however, there are the other components of said stack inside the inside space I as well. After the tightening, said screwing is carried out with a screwing means s, such as a screw driver. The method is in the above described referring to one screw member 5 only for the sake of clarity. However, the steps of the method can be carried out similarly for each screw member 5. Once the screwing is finished, said one or more plate elements, including said conductive plate element 4; 4*a*,4*b* have been attached immovably beside the end of the rope 1 resulting in the arrangement presented in FIG. 2. After said screwing, the rope 1 is removed from the jig 10 as illustrated in FIG. 11. The jig 10, in particular internal faces of the jig 10 delimiting said second portion of the inside space I, comprises grooves along which heads of the screw members 5 can slide away from the jig 10 when removing the rope 1 from the jig 10, whereby the jig 10 need only slightly opened so as to allow removal of the rope 1 from the jig 10 along with components attached immovably thereto. As visible in FIG. 11, the conductive plate element has at this stage two branches 4*a*,4*a*' and 4*b*;4*b*' each screwed between a pair of load bearing members 3. The branches are connected to each other by a neck portion whereby at this point these branches belong to same piece of plate. The arrangement can be finalized by cutting the neck whereby the branches are not anymore connected and they form contact elements separate from each other. By omitting said cutting, the arrangement is maintained in the form as illustrated with reference C1 in FIG. 1. By said cutting, the arrangement can be finalized into form as illustrated with reference C2 in FIG. 1. This way, easily two separate conducting plate elements can be attached immovably beside the rope end. Of course, with the method each plate element of arrangement C2 can be attached separately, if so desired.

The jig 10 is more specifically such that it comprises at least a first stop face F1*a* for supporting the thickness directional side (i.e. flank) of the rope 1 and a second stop face F2*a* for supporting the width directional side of the rope 1. Each said guide hole 11 is at a distance from the first stop face F1*a* corresponding to the distance (as measured in width direction of the rope) between the thickness directional side (i.e. the flank) of the rope 1 and the center of the gap between the load bearing members 3 of the rope 1 which are next to each other (as measured in width direction of the rope). The second stop face F2*a* is orthogonal to the first stop face F1*a*. Moreover, the jig 10 comprises two of said first stop faces F1*a* and F1*b* (one for each thickness directional side of the rope 1, i.e. flanks) at a distance from each other corresponding to the width of the rope 1.

Figure 2:
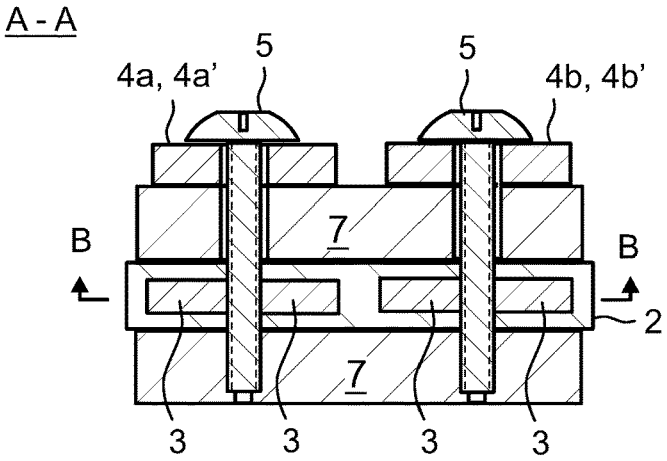
FIG. 2 illustrates cross section A-A of FIG. 1.

As mentioned, the hoisting rope 1 is belt-shaped, and thereby substantially larger in width direction w than in thickness direction t. Thereby the total resistance of the rope against bending around an axis extending in width direction w of the hoisting rope 1 is reduced. The width/thickness-ratio of the rope 1 is preferably at least 2 whereby the advantages related to the bending resistance become clearly substantial. Thus, also several load bearing members 3 can be fitted in the rope 1 adjacently. FIGS. 2, 7 and 10 also illustrate a preferred cross-section of the rope R as seen in longitudinal direction thereof. The rope 1 comprises a coating 2, and a plurality of adjacent load bearing members 3 for bearing the load exerted on the rope in longitudinal direction thereof embedded in the coating 2 and extending parallel to each other and to the longitudinal direction of the hoisting rope unbroken throughout the length of the rope 1. The coating 2 forms the surface of the rope 1 and extends between adjacent load bearing members 3 thereby isolating them from each other both mechanically and electrically. The rope could alternatively have some other number of load bearing members 3, either more or less than what is disclosed in the Figures. Each of said load bearing members 3 is in the preferred embodiment made of composite material comprising electrically conducting reinforcing fibers F in polymer matrix m. This makes the load bearing members 3 electrically conducting and thereby suitable for serving as conductors of the arrangement C1,C2. The fibers are most preferably carbon fibers as they are electrically conducting and have excellent properties in terms of load bearing capacity, weight and tensile stiffness, which makes them particularly well suitable for use in elevator hoisting ropes.

The preferred material and internal structure of the composite members 3 will be discussed in further detail in the following.

Figure 12A:
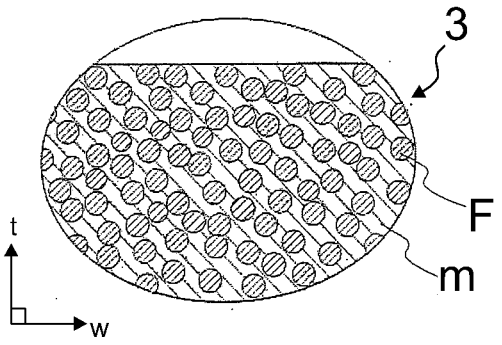
FIGS. 12*a* and 12*b* illustrate preferred details of the load bearing member of the rope of FIG. 1.

FIG. 12*a* illustrates a preferred inner structure of the load bearing member 3, showing in particular the cross section of the load bearing member 3 as viewed in the longitudinal direction I of the load bearing member 3. As mentioned, the load bearing members 3 are made of composite material comprising reinforcing fibers F embedded in polymer matrix m. The reinforcing fibers F are more specifically distributed in polymer matrix m and bound together by the polymer matrix, particularly such that an elongated rod-like piece is formed. Thus, each load bearing member 3 is one solid elongated rodlike piece. The reinforcing fibers F are distributed preferably substantially evenly in the polymer matrix m. Thereby a load bearing member with homogeneous properties and structure is achieved throughout its cross section. In this way, it can be also ensured that each of the fibers can be in contact and bonded with the matrix m. Said reinforcing fibers F are most preferably carbon fibers, but alternatively they can be of any other fiber material which is electrically conducting. The matrix m comprises preferably epoxy, but alternative materials could be used depending on the preferred properties. Preferably, substantially all the reinforcing fibers F of each load bearing member 3 are parallel with the longitudinal direction of the load bearing member 3. Thereby the fibers are also parallel with the longitudinal direction of the hoisting rope 1 as each load bearing member is oriented parallel with the longitudinal direction of the hoisting rope 1. Thereby, the fibers in the final rope 1 will be aligned with the force when the rope 1 is pulled, which ensures that the structure provides high tensile stiffness. This is also advantageous for achieving unproblematic behavior of the internal structure, particularly internal movement, when the rope 1 is bent.

The fibers F used in the preferred embodiments are substantially untwisted in relation to each other, which provides them said orientation parallel with the longitudinal direction of the rope 1. This is in contrast to the conventionally twisted elevator ropes, where the wires or fibers are strongly twisted and have normally a twisting angle from 15 up to 30 degrees, the fiber/wire bundles of these conventionally twisted elevator ropes thereby having the potential for transforming towards a straighter configuration under tension, which provides these ropes a high elongation under tension as well as leads to an unintegral structure.

The reinforcing fibers F are preferably long continuous fibers in the longitudinal direction of the load bearing member, the fibers F preferably continuing for the whole length of the load bearing member 3 as well as the rope R. Thus, the load bearing ability, good conductivity as well as manufacturing of the load bearing member 3 are facilitated. The fibers F being oriented parallel with longitudinal direction of the rope 1, as far as possible, the cross section of the load bearing member 3 can be made to continue substantially the same in terms of its cross-section for the whole length of the rope 1. Thus, no substantial relative movement can occur inside the load bearing member 3 when it is bent.

Figure 12B:
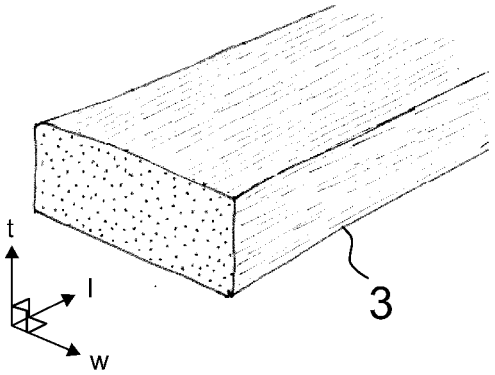

As mentioned, the reinforcing fibers F are preferably distributed in the aforementioned load bearing member 3 substantially evenly, in particular as evenly as possible, so that the load bearing member 3 would be as homogeneous as possible in the transverse direction thereof. An advantage of the structure presented is that the matrix m surrounding the reinforcing fibers F keeps the interpositioning of the reinforcing fibers F substantially unchanged. It equalizes with its slight elasticity the distribution of a force exerted on the fibers, reduces fiber-fiber contacts and internal wear of the rope, thus improving the service life of the rope 1. The composite matrix m, into which the individual fibers F are distributed as evenly as possible, is most preferably made of epoxy, which has good adhesiveness to the reinforcement fibers F and which is known to behave advantageously with carbon fiber. Alternatively, e.g. polyester or vinyl ester can be used, but alternatively any other suitable alternative materials can be used. FIG. 12*a* presents inside the circle a partial cross-section of the load bearing member 3 close to the surface thereof as viewed in the longitudinal direction of the rope 1. The reinforcing fibers F of the load bearing member 3 are preferably organized in the polymer matrix m according to this cross-section. The rest (parts not showed) of the load bearing member 3 have a similar structure. FIG. 12*b* illustrates three dimensionally a section of the load bearing member 3. From FIG. 12*a* it can also be seen how the individual reinforcing fibers F are substantially evenly distributed in the polymer matrix m, which surrounds the reinforcing fibers F. The polymer matrix m fills the areas between individual reinforcing fibers F and binds substantially all the reinforcing fibers F that are inside the matrix m to each other as a uniform solid substance. A chemical bond exists between, the individual reinforcing fibers F (preferably each of them) and the matrix m, one advantage of which is uniformity of the structure. To improve the chemical adhesion of the reinforcing fiber to the matrix m, in particular to strengthen the chemical bond between the reinforcing fiber F and the matrix m, each fiber can have a thin coating, e.g. a primer (not presented) on the actual fiber structure between the reinforcing fiber structure and the polymer matrix m. However, this kind of thin coating is not necessary. The properties of the polymer matrix m can also be optimized as it is common in polymer technology. For example, the matrix m can comprise a base polymer material (e.g. epoxy) as well as additives, which fine-tune the properties of the base polymer such that the properties of the matrix are optimized. The polymer matrix m is preferably of a hard non-elastomer as in this case a risk of buckling can be reduced for instance. However, the polymer matrix need not be non-elastomer necessarily, e.g. if the downsides of this kind of material are deemed acceptable or irrelevant for the intended use. In that case, the polymer matrix m can be made of elastomer material such as polyurethane or rubber for instance. The reinforcing fibers F being in the polymer matrix means here that the individual reinforcing fibers F are bound to each other with a polymer matrix m, e.g. in the manufacturing phase by immersing them together in the fluid material of the polymer matrix which is thereafter solidified. In this case the gaps of individual reinforcing fibers bound to each other with the polymer matrix comprise the polymer of the matrix. In this way a great number of reinforcing fibers bound to each other in the longitudinal direction of the rope are distributed in the polymer matrix. As mentioned, the reinforcing fibers are preferably distributed substantially evenly in the polymer matrix m, whereby the load bearing member is as homogeneous as possible when viewed in the direction of the cross-section of the rope. In other words, the fiber density in the cross-section of the load bearing member 3 does not therefore vary substantially. The individual reinforcing fibers of the load bearing member 3 are mainly surrounded with polymer matrix m, but random fiber-fiber contacts can occur because controlling the position of the fibers in relation to each other in their simultaneous impregnation with polymer is difficult, and on the other hand, perfect elimination of random fiber-fiber contacts is not necessary from the viewpoint of the functioning of the solution. If, however, it is desired to reduce their random occurrence, the individual reinforcing fibers F can be pre-coated with material of the matrix m such that a coating of polymer material of said matrix is around each of them already before they are brought and bound together with the matrix material, e.g. before they are immersed in the fluid matrix material.

As above mentioned, the matrix m of the load bearing member 3 is most preferably hard in its material properties. A hard matrix m helps to support the reinforcing fibers F, especially when the rope bends, preventing buckling of the reinforcing fibers F of the bent rope, because the hard material supports the fibers F efficiently. To reduce the buckling and to facilitate a small bending radius of the load bearing member 3, among other things, it is therefore preferred that the polymer matrix m is hard, and in particular non-elastomeric. The most preferred materials for the matrix are epoxy resin, polyester, phenolic plastic or vinyl ester. The polymer matrix m is preferably so hard that its module of elasticity E is over 2 GPa, most preferably over 2.5 GPa. In this case the module of elasticity E is preferably in the range 2.5-10 GPa, most preferably in the range 2.5-3.5 GPa. There are commercially available various material alternatives for the matrix m which can provide these material properties.

Preferably over 50% of the surface area of the cross-section of the load bearing member 3 is of the aforementioned electrically conducting reinforcing fiber. Thereby, good conductivity can be ensured. Fibers F will be in contact with each other randomly along their length whereby electricity brought into the load bearing member by the screws 5 will be conducted within substantially the whole cross section of the load bearing member. To be more precise preferably 50%-80% of the surface area of the cross-section of the load bearing member 3 is of the aforementioned reinforcing fiber, most preferably such that 55%-70% is of the aforementioned reinforcing fiber, and substantially all the remaining surface area is of polymer matrix. In this way conductivity and longitudinal stiffness of the load bearing member 3 are facilitated yet there is enough matrix material to bind the fibers F effectively to each other. Most preferably, this is carried out such that approx. 60% of the surface area is of reinforcing fiber and approx. 40% is of matrix material.

In the embodiments illustrated in FIGS. 1, 2, 7 and 10, the load bearing members 3 are substantially rectangular. However, this is not necessary as alternative shapes could be used. Said composite members 3 can be manufactured for example in any known way, such as in the manner presented in WO2009090299A1.

In the illustrated embodiment, the rope 1 comprises four load bearing members 3. Of course, alternative configurations are possible, where the contact arrangement C1,C2 is implemented with a rope provided with some other number of load bearing members 3.

The conductive plate element 4;4*a*;4*b* is most preferably made of a metal plate. It preferably comprises at least a completely flat portion for being set parallel with the width directional side of the rope 1. It may be completely flat as illustrated in the preferred embodiments, or alternatively comprise bends, e.g. made by bending a plate billet. It may additionally comprise perforations, e.g. made by perforating a plate billet.

Use of a jig is of particular value, when said load bearing members are made of composite material comprising electrically conducting reinforcing fibers in polymer matrix. With this type of load bearing members, establishing the electrical connection would be otherwise difficult owing to the mechanical properties of the composite material of the load bearing members. In particular, accuracy of the position of the screw is important because the material does not by itself guide the screw very effectively in a central position. Nor does the material, particularly when fragile, endure well forces caused by a misdirected screw. By using the jig 10, accuracy of the position of the screw can be ensured such that a proper and reliable electrical contact results with both of the load bearing next to each other.

When referring to conductivity, in this application it is meant electrical conductivity.

It is to be understood that the above description and the accompanying Figures are only intended to teach the best way known to the inventors to make and use the invention. It will be apparent to a person skilled in the art that the inventive concept can be implemented in various ways. The above-described embodiments of the invention may thus be modified or varied, without departing from the invention, as appreciated by those skilled in the art in light of the above teachings. It is therefore to be understood that the invention and its embodiments are not limited to the examples described above but may vary within the scope of the claims and their equivalents.

The invention claimed is:

1. A method for manufacturing an electrical contact arrangement on an end of a hoisting rope of a hoisting apparatus, which hoisting rope comprises a non-conductive coating, and a plurality of adjacent conductive load bearing members for bearing the load exerted on the hoisting rope in a longitudinal direction thereof embedded in the coating and extending parallel to each other and to the longitudinal direction of the hoisting rope unbroken throughout the length of the hoisting rope, the coating forming the surface of the hoisting rope and extending between adjacent load bearing members thereby isolating them from each other, said method comprising the steps of:

placing a conductive plate element beside the end of the hoisting rope; and attaching the conductive plate element immovably beside the end of the hoisting rope with at least one threaded screw member made of conductive material by screwing the at least one threaded screw member into the hoisting rope such that the at least one threaded screw member extends centrally between load bearing members next to each other, and such that the threads thereof are in contact with both of said load bearing members next to each other, the conductive plate element being thereby brought to be in conductive connection with both of said load bearing members next to each other via said at least one threaded screw member.

2. The method according to claim 1, wherein said at least one threaded screw member is screwed to compress with its screw head directly the conductive plate element, or indirectly via only conductive members.

3. The method according to claim 1, wherein before said placing and screwing, a hole is pre-drilled into the coating, which hole extends centrally between the load bearing members next to each other, and in said screwing the at least one threaded screw member is screwed into the pre-drilled hole.

4. The method according to claim 1, wherein before said pre-drilling, the hoisting rope is mounted on a jig comprising a plurality of stop faces configured to accurately place the hoisting rope relative to the jig when the hoisting rope is mounted on the jig, and the hole is pre-drilled into the coating while the rope is mounted on the jig.

5. The method according to claim 4, wherein said jig comprises one or more guide holes for guiding a drill bit of a drill, and each said pre-drilling is carried out by drilling through a guide hole while the rope is mounted on the jig.

6. The method according to claim 4, wherein said plurality of stop faces comprised in the jig are configured to accurately place the rope relative to the jig such that when the rope is mounted on the jig each guide hole points towards the center of the gap between load bearing members which are next to each other.

7. The method according to claim 1, wherein said rope is belt-shaped.

8. The method according to claim 4, wherein said mounting comprises tightening the hoisting rope immovably on the jig, in particular against stop faces of the jig.

9. The method according to claim 1, wherein said method further comprises placing beside the end of the hoisting rope one or more plate elements, said one or more plate elements including at least the conductive plate element, and said screwing is carried out while the rope and said one or more plate elements placed beside the end thereof, including the conductive plate element, are mounted on the jig.

10. An electrical contact arrangement on an end of a hoisting rope of a hoisting apparatus, which hoisting rope comprises a non-conductive coating, and a plurality of adjacent conductive load bearing members for bearing the load exerted on the hoisting rope in longitudinal direction thereof embedded in the coating and extending parallel to each other and to the longitudinal direction of the hoisting rope unbroken throughout the length of the rope, the coating forming the surface of the hoisting rope and extending between adjacent load bearing members thereby isolating them from each other, which electrical contact arrangement comprising:

a conductive plate element beside the end of the hoisting rope; and at least one threaded screw member attaching the conductive plate element immovably beside the end of the hoisting rope, which at least one threaded screw member has been screwed into the rope such that the at least one threaded screw member extends centrally between load bearing members next to each other, the threads thereof being in contact with both of said load bearing members next to each other, the at least on threaded screw member being made of conductive material, and the conductive plate element is in conductive connection with both of said load bearing members next to each other via said at least one threaded screw member.

11. The electrical contact arrangement according to claim 10, wherein said at least one threaded screw member has a screw-head compressed against the conductive plate element directly or indirectly via only conductive members.

12. An electrical contact arrangement on an end of a hoisting rope of a hoisting apparatus, which hoisting rope comprises a non-conductive coating, and a plurality of adjacent conductive load bearing members for bearing the load exerted on the hoisting rope in longitudinal direction thereof embedded in the coating and extending parallel to each other and to the longitudinal direction of the hoisting rope unbroken throughout the length of the rope, the coating forming the surface of the hoisting rope and extending between adjacent load bearing members thereby isolating them from each other, which electrical contact arrangement comprising:

a conductive plate element beside the end of the hoisting rope; and at least one threaded screw member attaching the conductive plate element immovably beside the end of the hoisting rope, which at least one threaded screw member has been screwed into the rope such that the at least one threaded screw member extends centrally between load bearing members next to each other, the threads thereof being in contact with both of said load bearing members next to each other, the at least one threaded screw member being made of conductive material, and the conductive plate element is in conductive connection with both of said load bearing members next to each other via said at least one threaded screw member, wherein electrical contact arrangement has been obtained with the method according to claim 1.

13. An arrangement for condition monitoring of a hoisting rope of a hoisting apparatus, wherein load bearing members of the hoisting rope that are next to each other, are in conductive connection with each other and form part of an electrical circuit whereto a source of electricity is connected, which arrangement for condition monitoring comprising:

a monitoring unit for monitoring one or more electrical parameters of the electrical circuit so as to determine a condition of the circuit, the condition monitoring unit being configured to deduce the condition of the load bearing members of the hoisting rope based on the condition of the circuit, the arrangement comprising on at least one end of the hoisting rope the electrical contact arrangement as defined in claim 10 connecting said load bearing members of the hoisting rope that are next to each other to be in conductive connection with each other.

14. The arrangement for condition monitoring of a hoisting rope of a hoisting apparatus according to claim 13, wherein said conductive plate element of the electrical contact arrangement is a contact element directly coupled with a contact element of a source of electricity.

15. The arrangement or method according to claim 1, wherein said load bearing members are made of composite material comprising electrically conducting reinforcing fibers in a polymer matrix.

16. The method according to claim 1, wherein said at least one threaded screw member is screwed to compress with its screw head directly the conductive plate element, or indirectly via only one or more washers.

17. The method according to claim 1, wherein before said pre-drilling, the hoisting rope is mounted on a jig comprising a plurality of stop faces configured to accurately place the hoisting rope relative to the jig when the hoisting rope is mounted on the jig, placed against the stop faces, and the hole is pre-drilled into the coating while the rope is mounted on the jig.

18. The method according to claim 1, wherein said method further comprises placing beside the end of the hoisting rope one or more plate elements, such that they form a stack, said one or more plate elements including at least the conductive plate element, and said screwing is carried out while the rope and said one or more plate elements placed beside the end thereof, including the conductive plate element, are mounted on the jig.

19. The electrical contact arrangement according to claim 10, wherein said at least one threaded screw member has a screw-head compressed against the conductive plate element directly or indirectly via only one or more washers.

20. The arrangement or method according to claim 1, wherein said load bearing members are made of composite material comprising electrically conducting reinforcing fibers in a polymer matrix, said reinforcing fibers being carbon fibers.

* * * * *